US005895276A

United States Patent [19]

Rothenberger

[11] Patent Number: 5,895,276

[45] Date of Patent: Apr. 20, 1999

[54] HIGH SPEED AND HIGH DENSITY BACKPLANE CONNECTOR

[75] Inventor: Richard Ellis Rothenberger, Bainbridge, Pa.

[73] Assignee: The Whitaker Corporation, Wilmington, Del.

[21] Appl. No.: 08/754,350

[22] Filed: Nov. 22, 1996

[51] Int. Cl.[6] ..... H01R 9/09

[52] U.S. Cl. ..... 439/67; 439/108; 439/660

[58] Field of Search ..... 439/79, 80, 67, 439/65, 108, 660

[56] References Cited

U.S. PATENT DOCUMENTS

| | | | |
|---|---|---|---|
| 4,392,705 | 7/1983 | Andrews, Jr. et al. . | |
| 4,808,115 | 2/1989 | Norton et al. | 439/79 |
| 5,046,960 | 9/1991 | Fedder | 439/108 |
| 5,106,311 | 4/1992 | Yodogawa et al. | 439/77 |
| 5,174,764 | 12/1992 | Kandybowski et al. | 439/83 |
| 5,199,880 | 4/1993 | Arai | 439/65 |
| 5,238,414 | 8/1993 | Yaegashi et al. | 439/108 |
| 5,376,011 | 12/1994 | Rudy, Jr. et al. | 439/79 |
| 5,415,569 | 5/1995 | Colleran et al. | 439/620 |
| 5,484,310 | 1/1996 | McNamara et al. | 439/608 |

FOREIGN PATENT DOCUMENTS 05275139 10/1993 Japan .

OTHER PUBLICATIONS

Connector Design Reduces Crosstalk Electronic Packaging and Production, vol. 30, No. 5, May 1, 1990, p. 41 XP000109524.

*Primary Examiner*—Neil Abrams
*Attorney, Agent, or Firm*—Mary K. VanAtten

[57] ABSTRACT

The invention comprises an electrical connector assembly for connecting a daughter card to a mother board including a first housing (20) having contacts (34, 38) mounted therein. The contacts (34, 38) are electrically connected to the daughter card. A second housing (24) is mounted along the edge of the daughter card. The second housing (24) has a mating face and a connecting face. The second housing has contacts (90, 92) mounted therein. The contacts (90, 92) of the second housing are electrically connected to the contacts (34, 38) in the first housing by an impedance controlled flexible film (110). The mating face has a plurality of contact protrusions (88) forming a field. The contact protrusion (88) have one ground contact (92) disposed along one side and two signal contacts (90) disposed along another side to form a differential pair for engaging contacts (126, 128) on the motherboard.

28 Claims, 11 Drawing Sheets

HIGH SPEED AND HIGH DENSITY BACKPLANE CONNECTOR

FIELD OF THE INVENTION

The present invention relates to high speed transmission electrical connectors for connecting daughter cards to mother boards.

BACKGROUND OF THE INVENTION

Typically, daughter cards are mated to mother boards through a right angle connector. It is important that the right angle connector provide both high speed transmission between the mother board and the daughter cards and also to provide controlled impedance between the signals.

U.S. Pat. No. 4,392,705 discloses a right angle connector for electrically connecting a circuit card to a circuit board. The backplane connector comprises a connector mounted on the edge of the daughter card wherein contacts extend from the daughter card to provide a right angle connection to the surface of the daughter card. The backplane connector further comprises a second connector housing mounted on the mother card to receive the contacts from the connector on the daughter card. The contacts on the daughter card provide a right angle connection by having solder tails to provide electrical connection to the daughter card and contact ends which extends substantially parallel to the surface of the daughter card.

What is needed is a separable connector to provide a right angle connection from the daughter card to the mother board. Further, it is necessary to provide controlled impedance for the electrical connection between the daughter card and the mother board.

SUMMARY OF THE INVENTION

The invention comprises an electrical connector assembly for connecting a daughter card to a mother board including a first housing having contacts mounted therein. The contacts are electrically connected to the daughter card. A second housing is mounted along the edge of the daughter card. The second housing has a mating face and a connecting face. The second housing has contacts mounted therein. The contacts of the second housing are electrically connected to the contacts in the first housing. The mating face has a plurality of contact protrusions forming a field. The contact protrusions have one contact disposed along one side and two contacts disposed along another side to form a differential pair.

The invention is further directed to an electrical connector assembly for connecting a daughter card to a mother board having a first housing with contacts mounted therein. The contacts is electrically connected to the daughter card. A second housing is mounted along the edge of the daughter card. The second housing has a mating face and a connecting face. The second housing has contacts mounted therein. The mating face has a plurality of contact protrusions forming a field. The contact protrusions have one contact disposed along one side and two contacts disposed along another side to form a differential pair. The contacts of the second housing are electrically connected to the contacts of the first housing by a flex film.

The invention further comprises an electrical connector assembly for connecting a daughter card to a mother board including a first housing having contacts mounted therein. The contacts are electrically connected to the daughter card and have a connection section. A second housing is mounted along the edge of the daughter card. The second housing has a mating face and a connecting face. The second housing has contacts mounted therein. The contacts of the second housing are electrically connected to the contacts in the first housing. The mating face has a plurality of contact protrusions forming a field. The contact protrusions have one contact disposed along one side and two contacts disposed along another side to form a differential pair. A third housing is mounted on the mother board. The third housing has contacts therein which are electrically connected to the mother board. The third housing has a plurality of openings to receive the contact protrusions. The openings have one contact disposed along one side and two contacts disposed along the other side to be connected with the contacts on the contact protrusion.

BRIEF DESCRIPTION OF THE DRAWINGS

An embodiment of the present invention will now be described with reference to the accompanying drawings, in which.

DETAILED DESCRIPTION OF THE DRAWINGS

Figure 1:
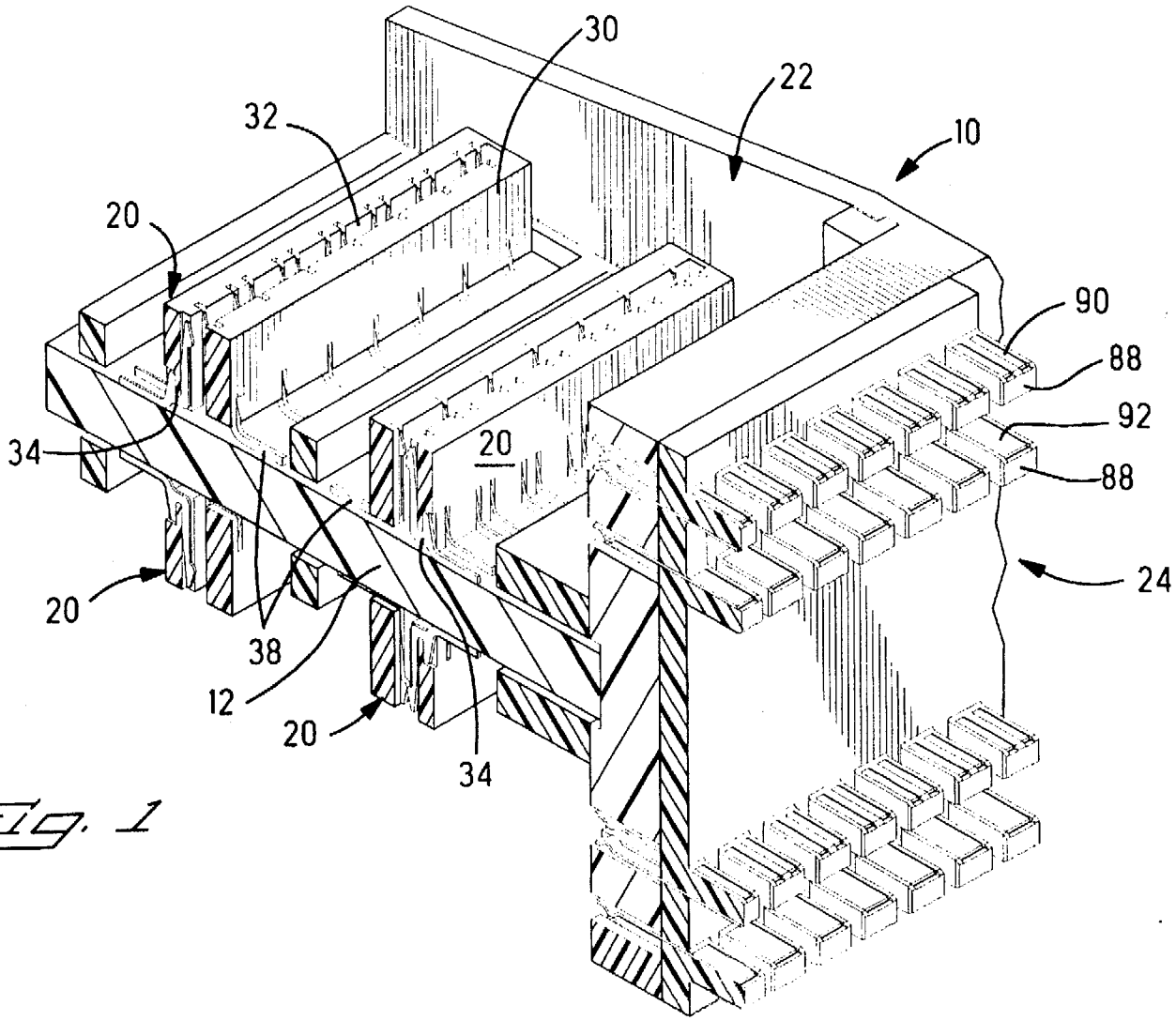
FIG. 1 is an isometric, cross-sectional view of the daughter card connector of the present invention.

FIG. 1 shows the card edge connector assembly 10 assembled to an edge of a daughter card 12. The card edge assembly 10 is used to electrically connect the daughter card to a backplane or a mother board. The card edge assembly will mate with a backplane connector mounted onto the backplane or the mother board.

The card edge assembly 10 includes a first housing 20 which is mounted onto the daughter card 12. In the drawing, there are four first housings shown mounted to the daughter card, two on each side of the daughter card. The first housings 20 will be mounted along substantially the entire length of the edge of the card, so there will be a plurality of first housings forming two rows on either side of the daughter card. The card edge assembly also includes a frame 22 which is used to secure the assembly together. The assembly 10 also includes an edge connector 24 which is mounted on the edge of the daughter card 12 and provides connection projections 88 to connect with the backplane connector as will be described hereinafter.

The first housing 20 has a housing body 30 which has a slot 32 extending in a longitudinal direction along the housing body 30. Disposed along either side of the slot 32 are signal contacts 34 and ground contacts 38. The signal contacts 34 are disposed along one side of the slot 32 and the ground contacts 38 are disposed along the other side. In the housing 20, two signal contacts 34 are associated with each ground contact 38.

The signal contacts 34 each have a contact section 35, a solder tail 36, and a securing arm 37. Similarly, the ground contacts 38 each have a contact section 39, a solder tail 40, and a securing arm 41, see FIG. 2. The signal contacts and the ground contacts are substantially identical to each other.

Figure 4:
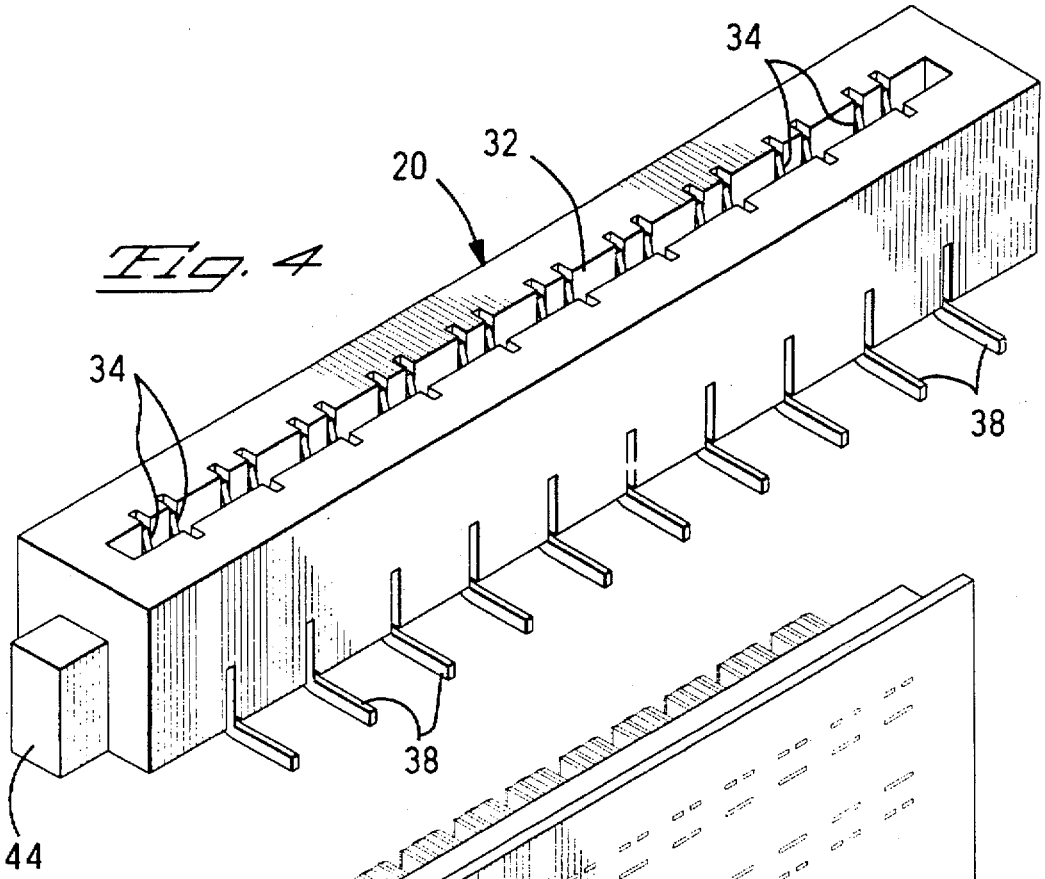
FIG. 4 is an isometric view of the first housing.

The housing 20 has embossments 44 which are disposed along either end, only one of which is shown in FIG. 4. The embossments 44 are used to secure the housing 20 to the frame 22 as will be described later. The housing 20 is mounted onto the daughter card 12 so that the solder tails are lined up with contact pads on the daughter card for electrical connection therewith.

Figure 3:
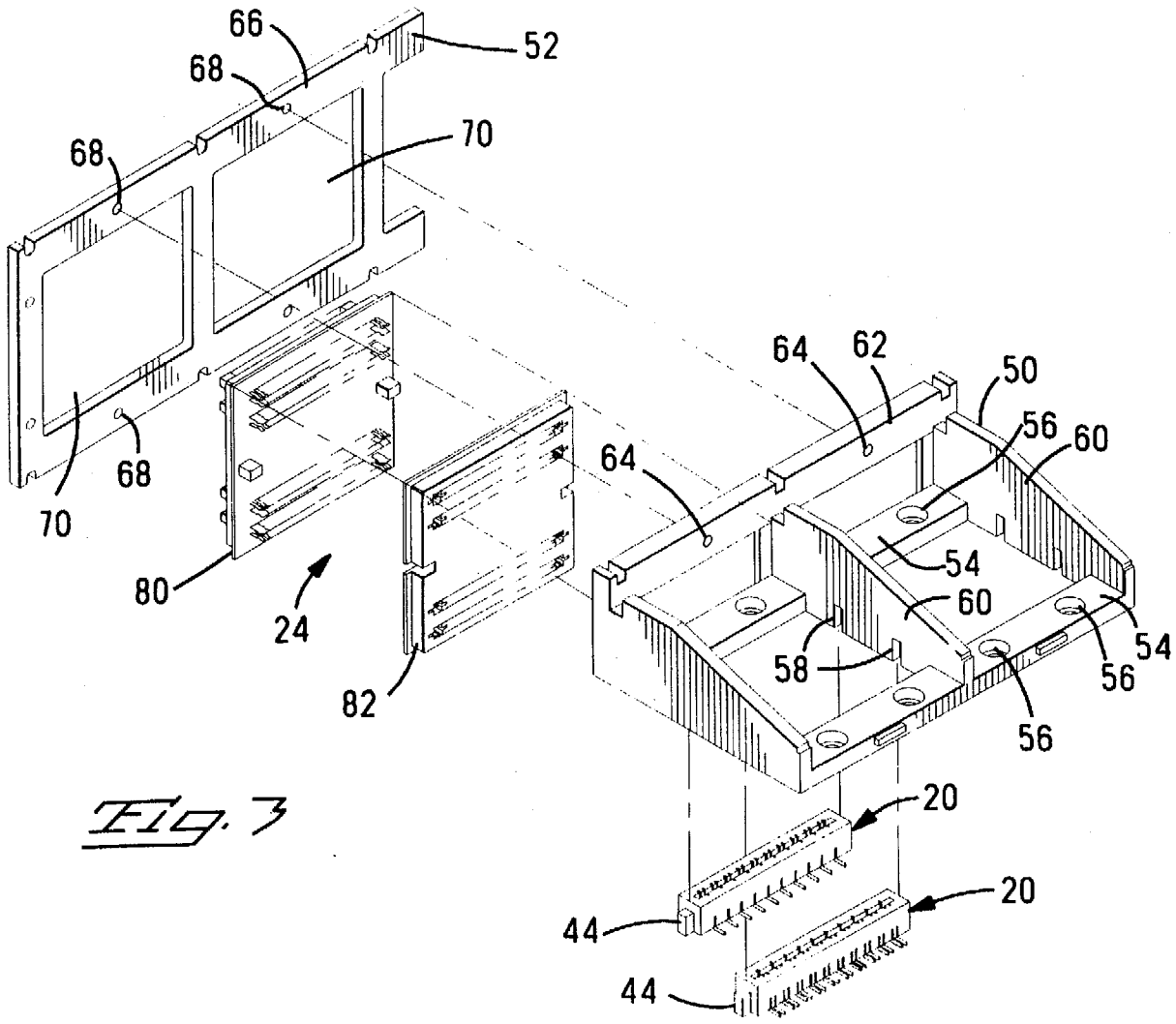
FIG. 3 is an exploded view of the connector assembly which is mounted onto the daughter card.

The frame 22 includes a first section 50 and an edge section 52, see FIG. 3. The first section 50 has arms 54 with mounting holes 56 therein. The mounting holes 56 are used to secure the first section of the frame to the daughter card 12. The first section 50 has walls 60 with slots 58 therealong. The walls 60 separate adjacent sets of first housings 20 and the slots 58 receive embossments 44 therein for aligning the first housings 20 on the daughter card 12. The first section 50 has arms 62 with mounting holes 64 therealong. The mounting holes 64 are used to secure the edge section 52 of the frame to the first section 50.

The edge section 52 has arms 66 with mounting holes 68 therealong for securing the edge section 52 to the first section 50. The edge section 52 has openings 70 in which the edge connector 24 is received.

Figure 5:
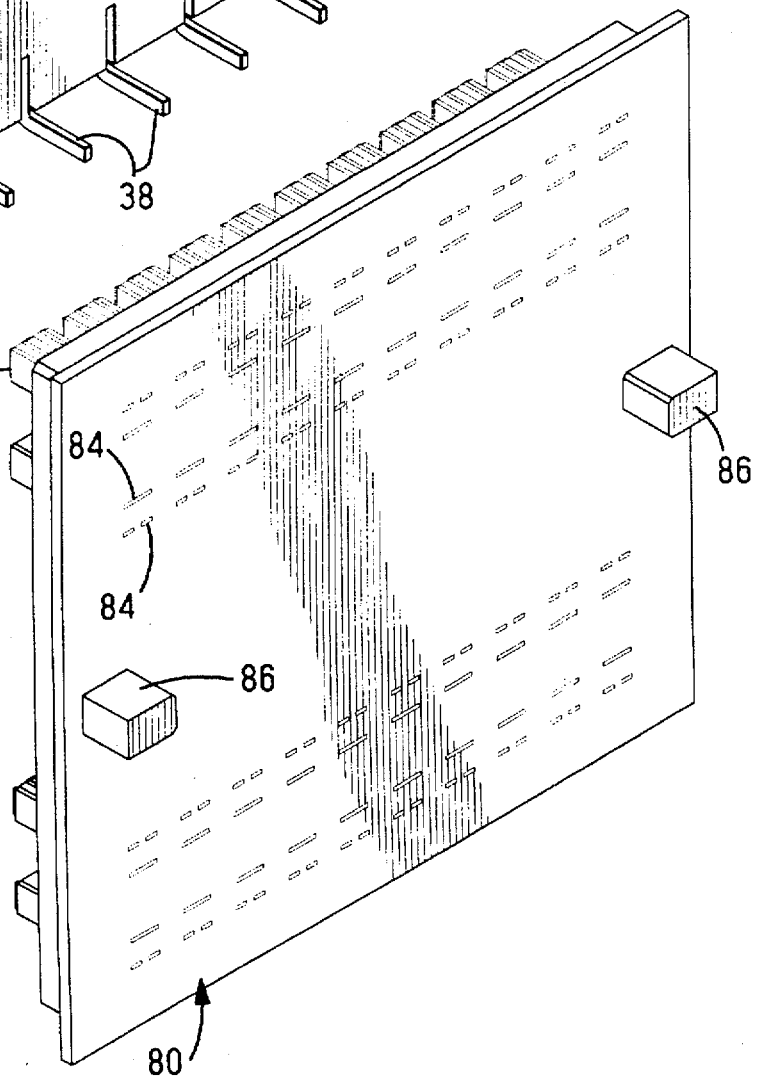
FIG. 5 is a rear view of the edge connector.

The edge connector 24 is made up of two housings, a first housing 80 and a cap housing 82, as is shown in FIG. 3 and FIGS. 5–8. FIG. 5 shows the first housing 80 which has a flat surface with contact passages 84 therealong to provide access for the contacts to extend from one surface to the other. The flat surface also has embossments 86 which are used to align the first housing 80 with the cap housing 82. Along the opposite side of the housing, as shown better in FIG. 1, the first housing has contact projections 88. These projections 88 have slots therealong for receiving the signal contacts on one side and the ground contacts on the other side.

Figure 7:
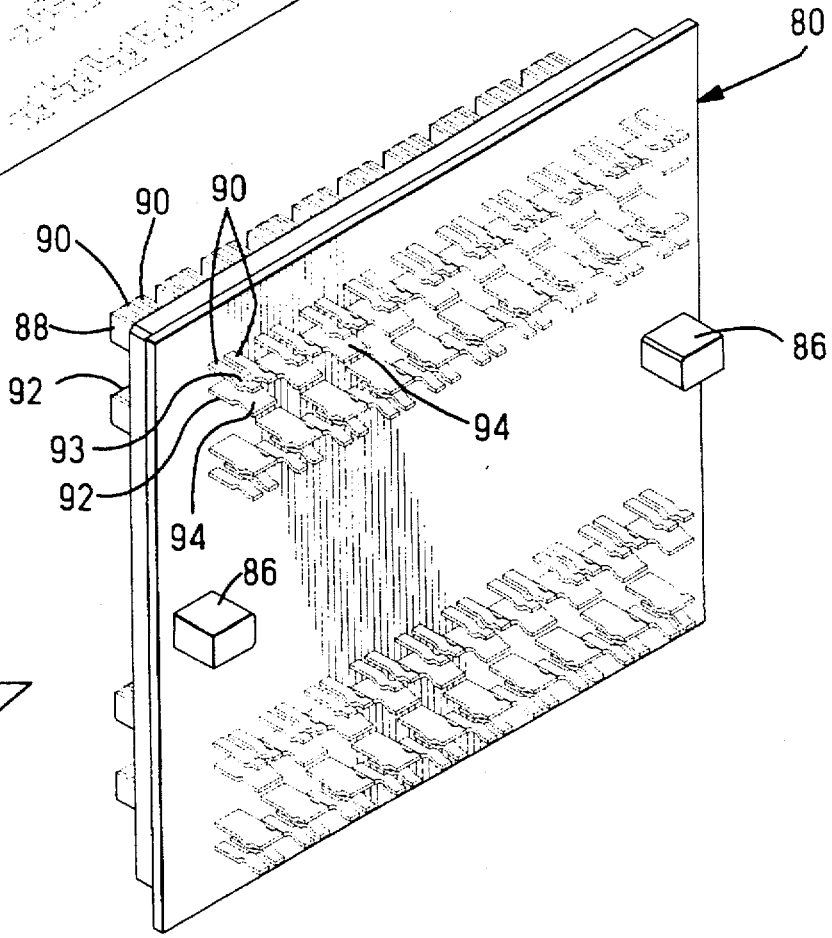
FIG. 7 is a rear view of the edge connector showing the contacts mounted therein.

FIG. 7 shows the signal contacts 90 and the ground contacts 92 secured within the first housing 80. The contacts have resilient contacting sections 93 and 94 disposed along the flat surface of the first housing 80. As shown in FIG. 1 the opposite end of the signal contacts 90 and the ground contacts 92 are flat surfaces to provide an electrical connection surface with another contact having a resilient finger, see FIG. 2.

Figure 6:
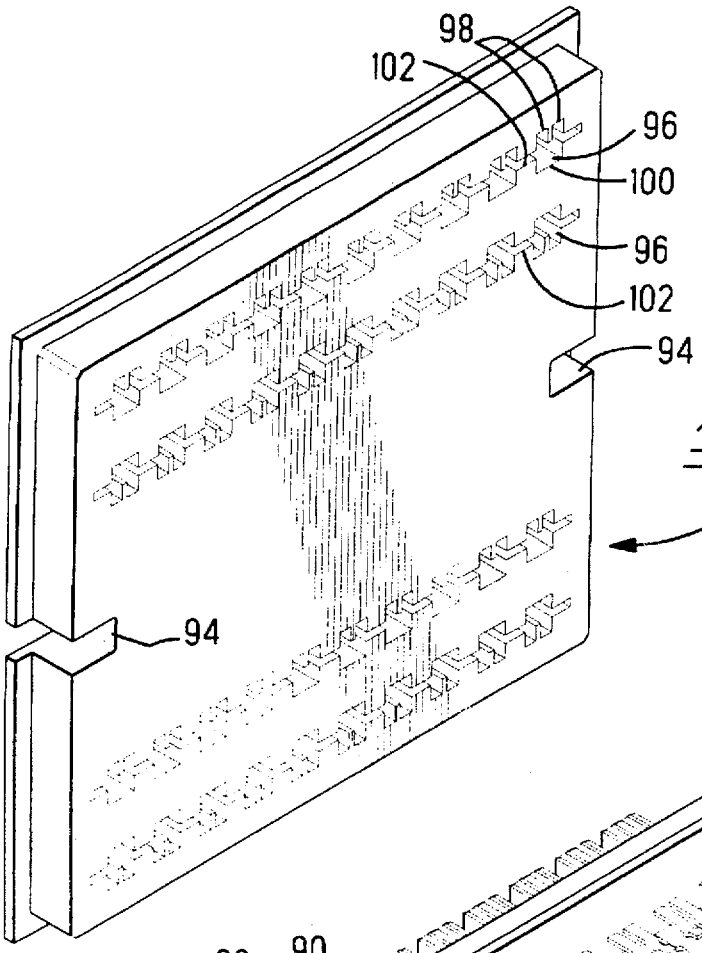
FIG. 6 is a rear view of the cap housing of the edge connector.
Figure 8:
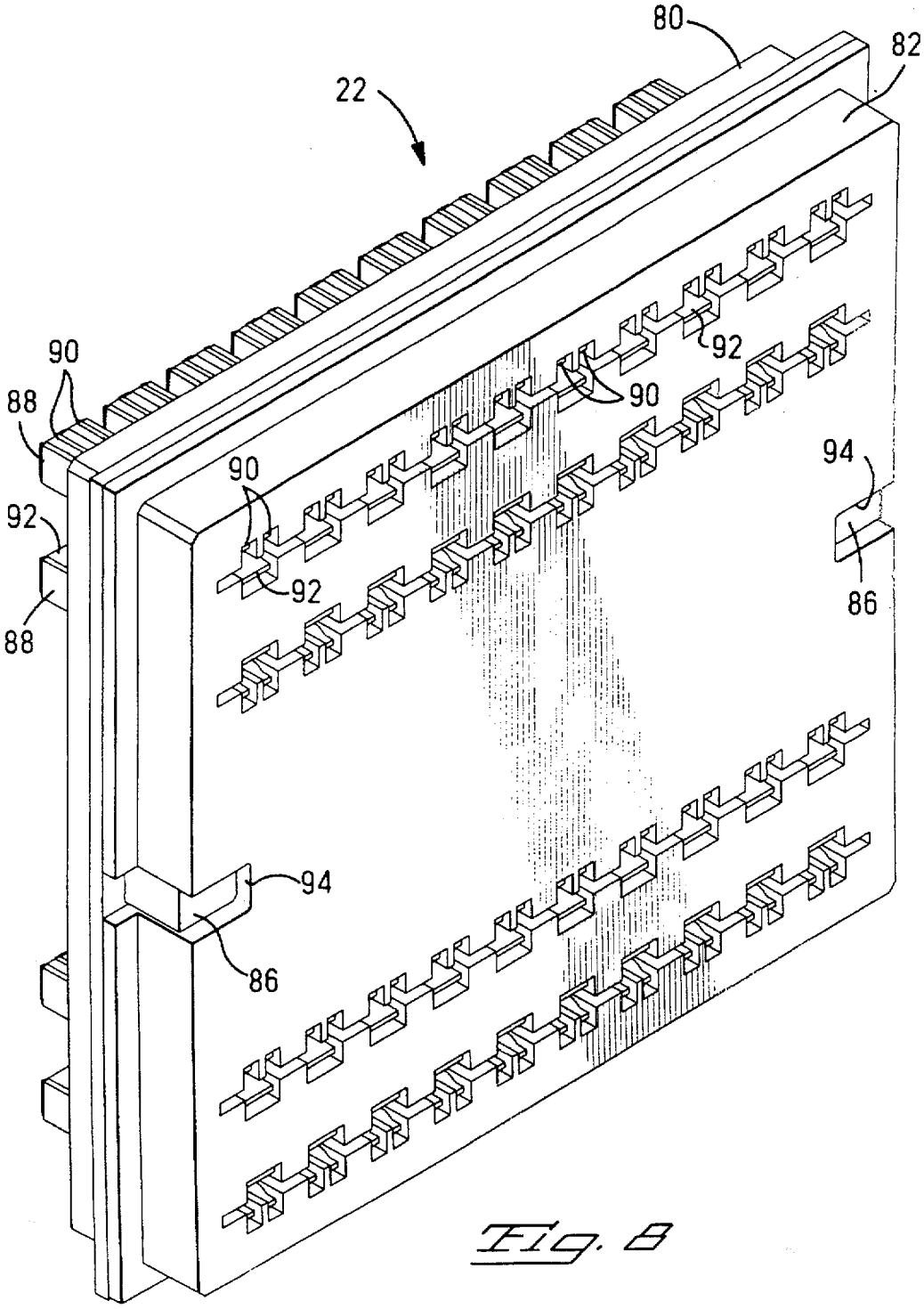
FIG. 8 is rear view of the assembled edge connector.

FIG. 6 shows the cap housing 82. The cap housing has openings 94 along either end to receive embossments 86 to align the first housing with the cap housing. The cap housing 82 also has contact openings 96 wherein each contact opening provides two areas 98 for receiving the signal contacts 90 and one area 100 for receiving the ground contact 92, wherein one ground contact is associated with two signal contacts within each contact opening 96. The contact openings 96 are connected together with a slot 102 which runs along the length of the cap housing 82 to connect all contact openings in a row. When the first housing and the cap housing are assembled to form the edge connector 24, as is shown in FIG. 8, the signal contacts 90 are received in the areas 98 of the contact openings and the ground contacts 92 are received in the areas 100 of the contact openings 96. This assembled edge connector 24 can then be mounted onto the edge section 52 of the frame 22.

The whole assembly 10 is mounted onto the edge of the daughter card 12, as is illustrated in FIG. 1. Two of the first sections 50 are assembled along either side of the daughter card 12 so that the first housings 20 are mounted along both sides of the daughter card. The edge section 52, along with the edge connector 24, are then secured along the edge of the daughter card 12. This assembly provides two rows of signal and ground contacts which are disposed along each side of the daughter card.

Figure 2:
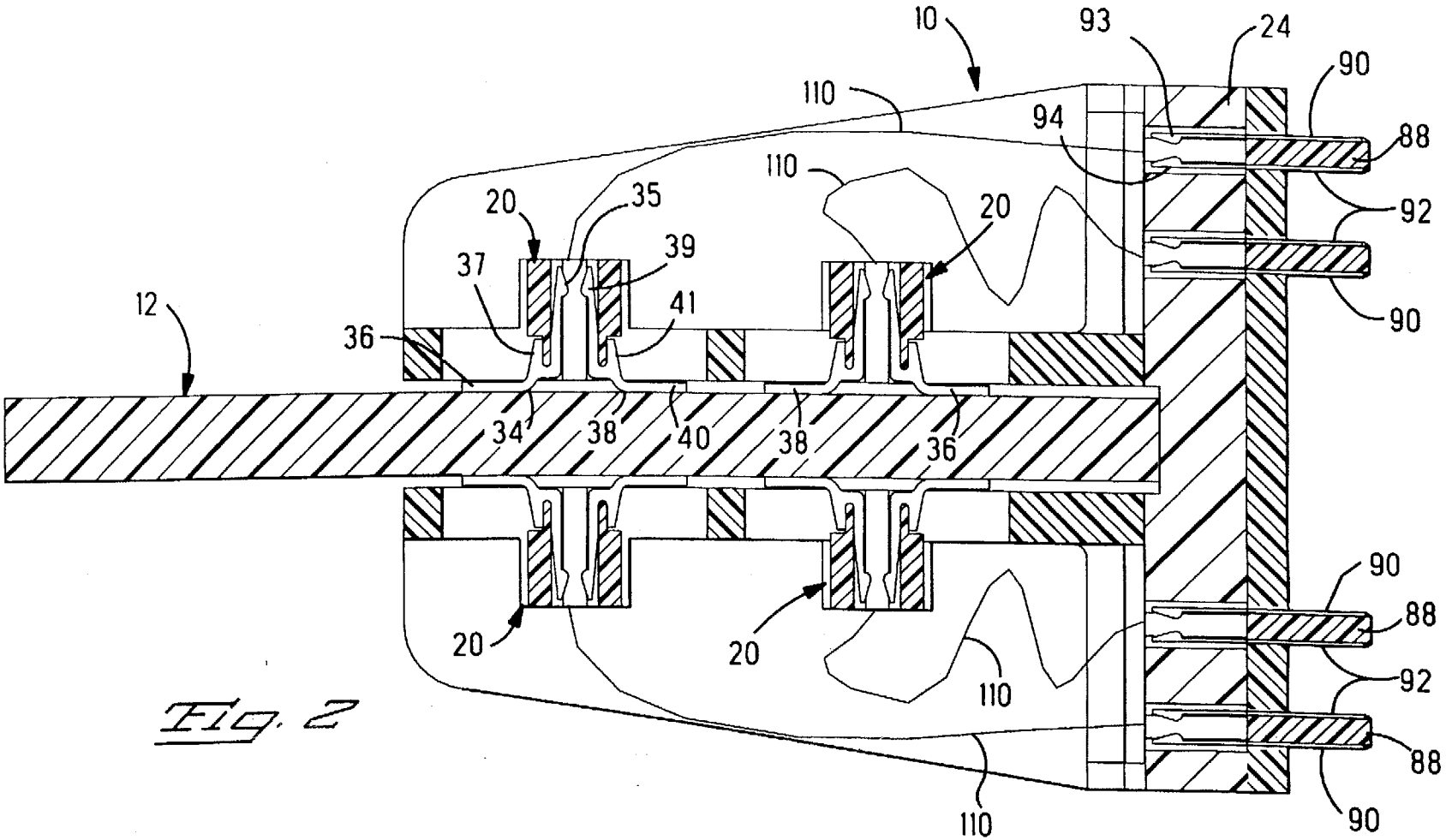
FIG. 2 is a cross-sectional view of the daughter card connector.

FIG. 2 shows the assembly 10 of the connector secured to the daughter card 12. First housings 20 are secured on both sides of the daughter card and the edge connector 24 is secured along the end of the daughter card. Electrical connection is provided between the first housings 20 and edge connectors 24 by way of controlled impedance flexible film 110. The flexible film 110 provides electrical connection along one side from the ground contacts 38 in the first housing 20 to the ground contact 92 in the edge connector 24. Along the opposite side of the flexible film 110, the signal contacts 34, 90 are connected between the first housings 20 and the edge connectors 24. The flex film provides a controlled impedance path to minimize reflection of the signals.

Figure 9:
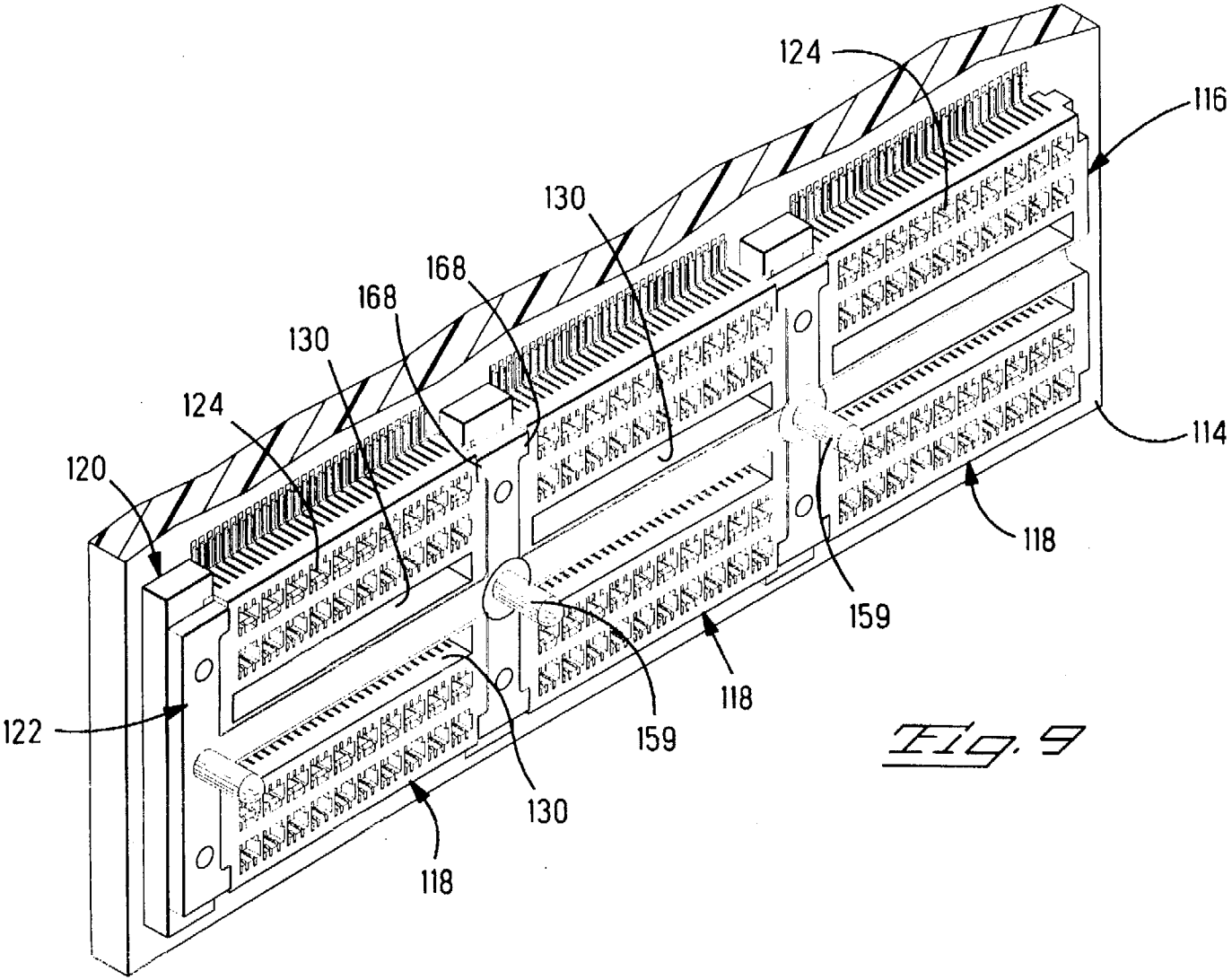
FIG. 9 is an isometric view of the backplane connector assembled to the backplane.

FIG. 9 shows the backplane connector 116 assembled to the backplane board or the mother board 114. The backplane connector includes connector housing 118, underframe 120, and overframe 122. The connector housing 118 includes two pairs of rows of openings 124 with signal contacts 126 and ground contacts 128 disposed therein. The connector housing 118 also has two slots 130 disposed along the center of the housing 118, the purpose of which will be described more fully hereinafter.

Figure 13:
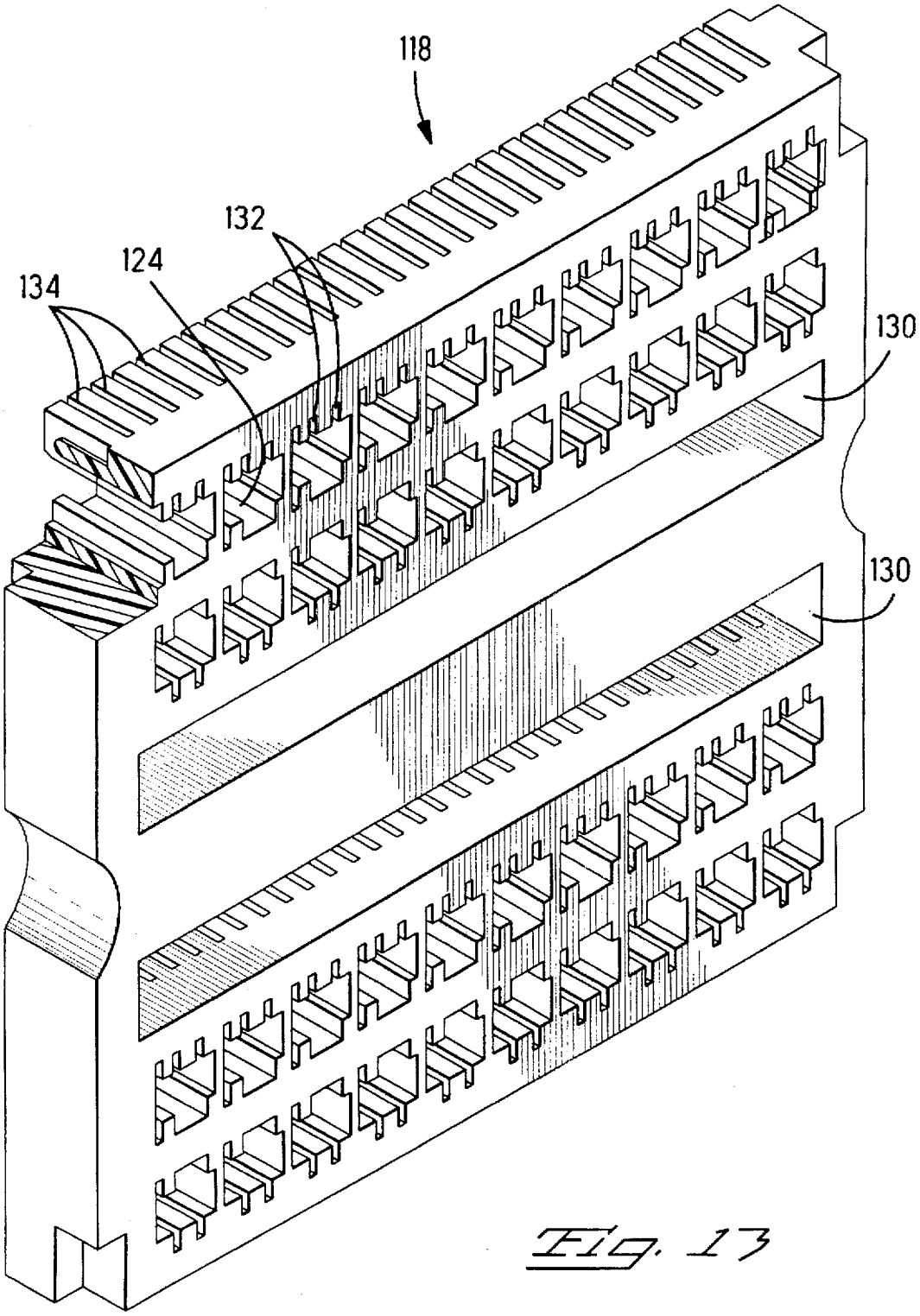
FIG. 13 is a partial cut away of the backplane connector.
Figure 14:
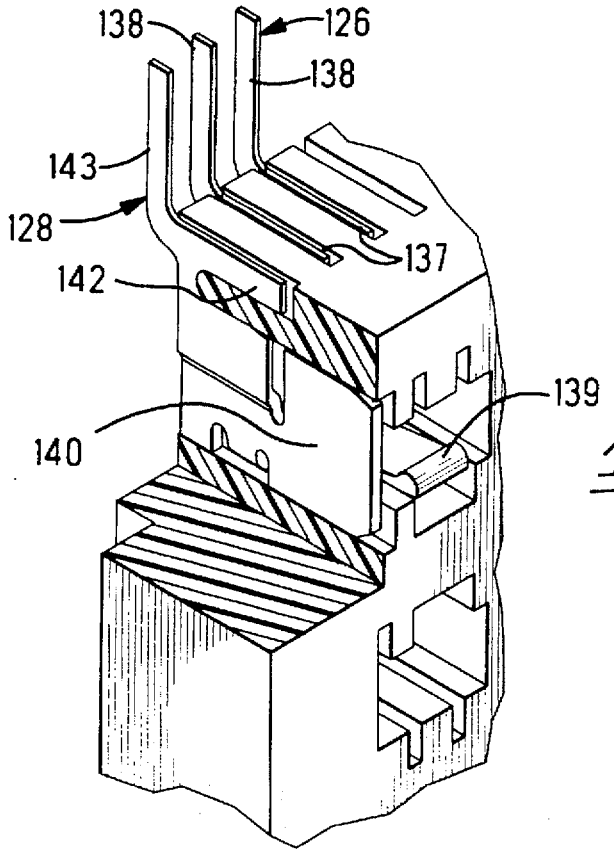
FIG. 14 is a view similar to FIG. 13 showing the contacts assembled therein.

The connector housing 118 is shown in more detail in FIG. 13. The openings 124 each have two slots 132 in which the signal contacts 126 are received. Along the outer edge of the connector housing are slots 134 through which the contacts will also be received. FIG. 14 shows the ground contact 128 and the signal contacts 128 assembled within the connector housing 118.

Figure 15:
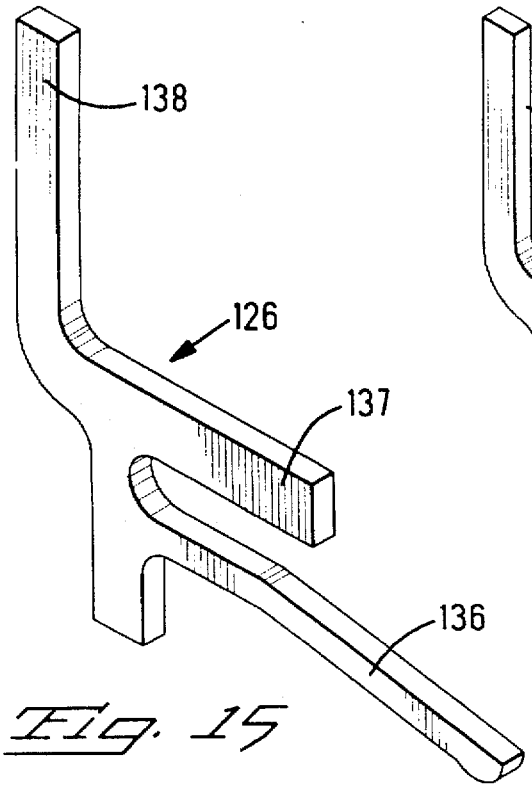
FIG. 15 is an isometric view of the signal contact used for the backplane connector.
Figure 16:
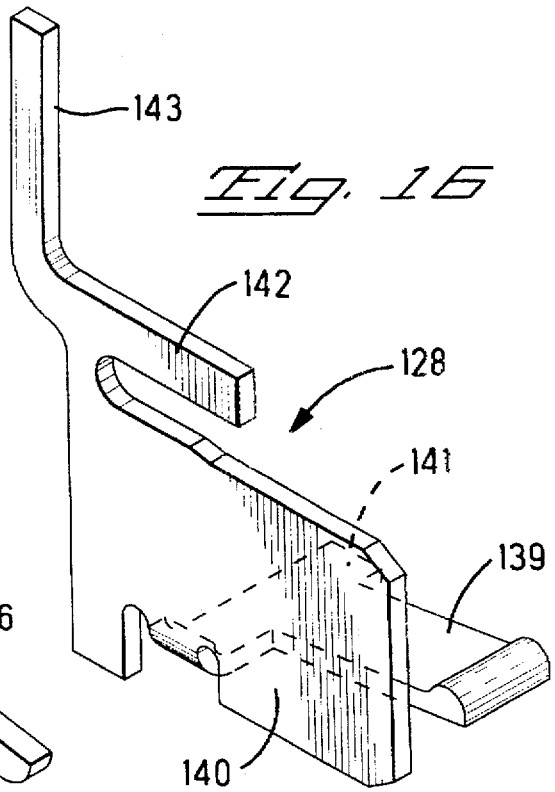
FIG. 16 is an isometric view of the ground contact used in the backplane connector.

FIG. 15 shows the signal contact 126. The signal contact 126 has a contacting section 136 which is a resilient arm, a retaining arm 137, and a solder tail 138. FIG. 16 shows the ground contact 128. The ground contact includes a ground contacting arm 139 which extends from base 141. The contact 128 also has a wall section 140 from which the base 141 extends at a right angle. Further the contact 128 has a retaining arm 142 and a solder tail 143.

Figure 11:
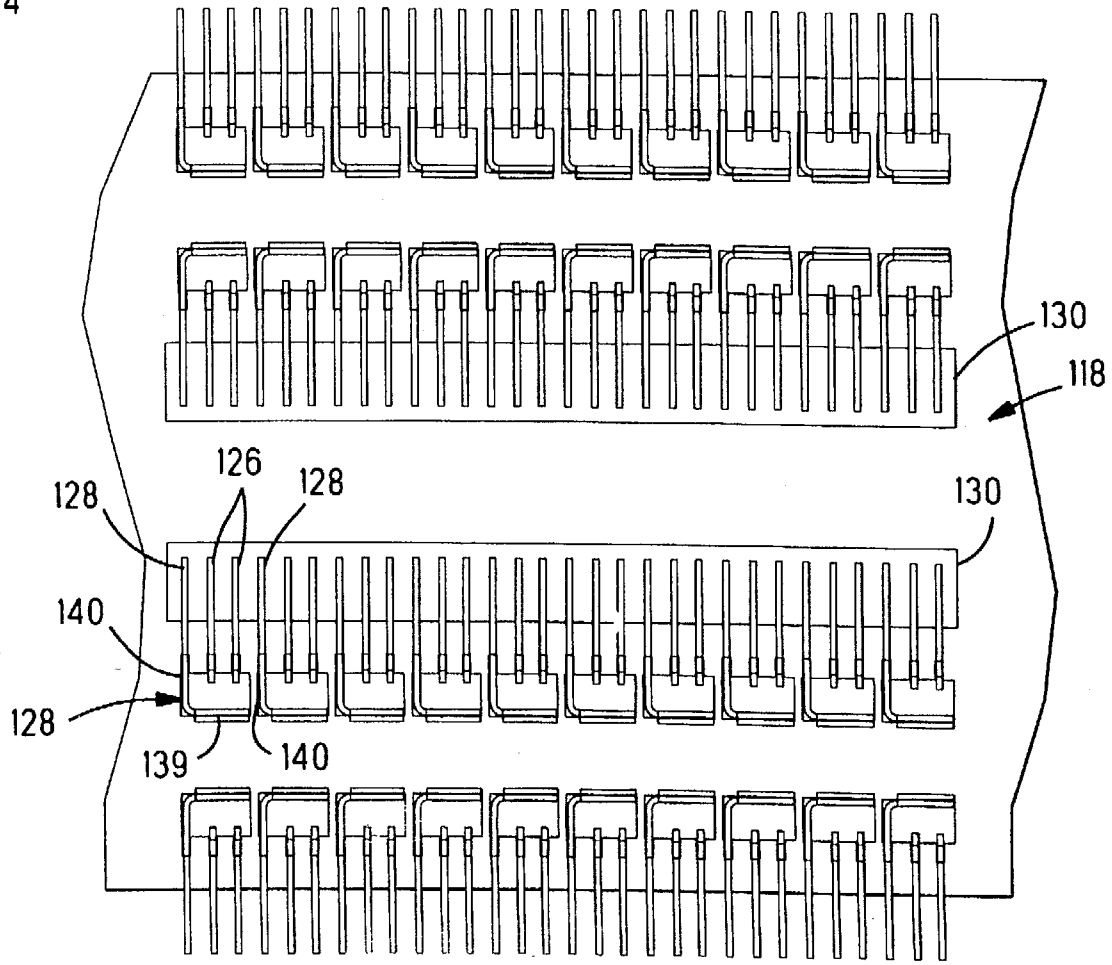
FIG. 11 is a bottom view of the backplane connector showing the assembly of the contacts therein.

FIG. 14 shows a ground contact 128 along with two signal contacts 126 mounted within the connector housing 118. As can be seen the solder tails 138, 143 are aligned with each other such that two signal contacts are disposed between the ground contacts. Further, the wall 140 of the ground contact 128 is received along one edge of the opening 124 and the contacting arm 139 of the ground contact is received along one edge. The signal contacts are received within the slot and both the signal and ground contacts are retained within the housing by retaining arms 137, 142. When the connector is fully assembled with contacts, pairs of signal contacts 126 will be electrically isolated from adjacent pairs by the ground contact 128 and each signal pair will have an independent reference ground associated with it. FIG. 11 shows a bottom view of the electrical connector housing 118 fully loaded with contacts. The pairs of signal contacts 126 are completely isolated from adjacent pairs by the ground contacts 128, they are also isolated from pairs that run along the adjacent row of contacts. The solder tails 138, 143 are all aligned with each other along one row. Therefore, there are four rows of solder tails to be secured to the backplane.

Figure 10:
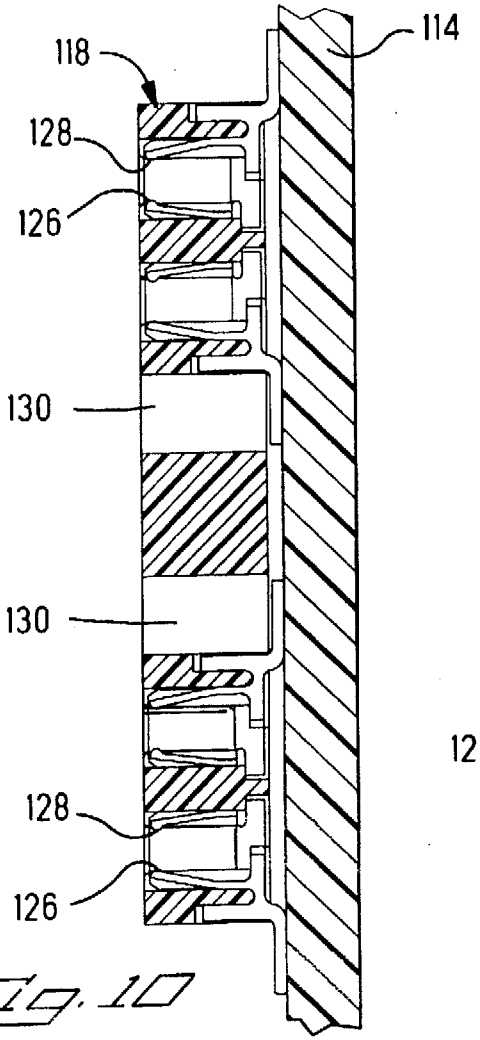
FIG. 10 is cross sectional view of the backplane connector mounted onto the backplane.

Slot 130 extends over one row of the solder tails to provide easy access to solder the solder tails to the backplane. FIG. 10 shows a cross-sectional view of the connector housing 118 mounted onto the backplane. Here can be seen that the one row of solder tails is aligned with the slot 130 to provide ease of soldering. Further it can be seen that the contacts are secured within the connector housing by retaining arms 137, 142.

Figure 12:
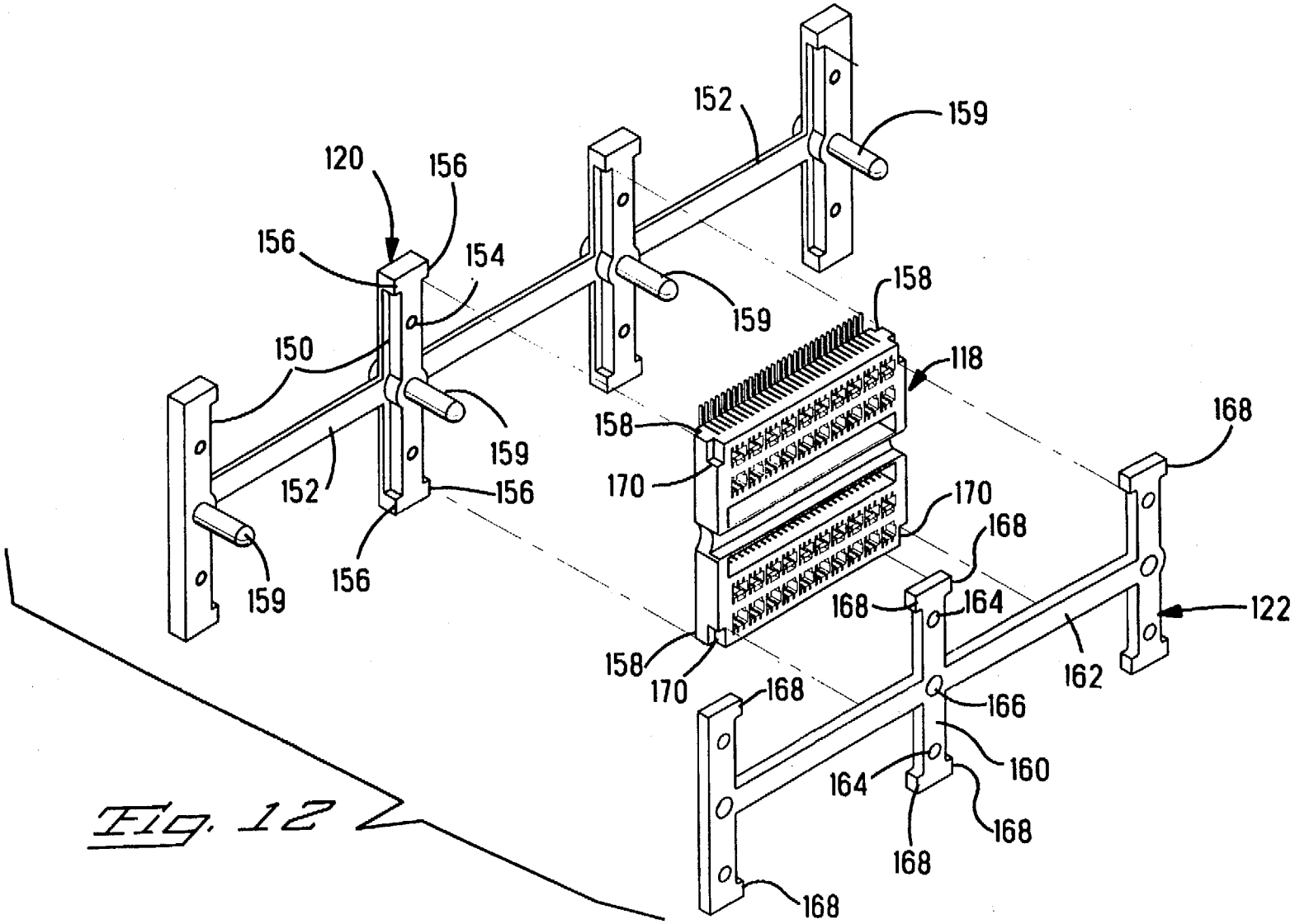
FIG. 12 is an exploded isometric view of the backplane connector.

FIG. 12 shows the assembly of the connector housing 118 with the underframe 120 and the overframe 122. Underframe 120 has arms 150 which are at right angles with arms 152. Arms 152 are received underneath the connector housing 118 and arms 150 will be received between adjacent connector housings 118. Arms 150 have mounting holes 154 disposed therealong. Along either end of arms 150 are T-projections 156. The T-projections are received within recesses 158 on the connector housing 118 to align and secure the connector thereto. Underframe 120 has embossments 159 which are used to align the connector housing 118 and the overframe 122.

The overframe 122 has arms 160 and cross arms 162. Arms 160 have mounting holes 164 and openings 166. When assembled, mounting holes 164 align with mounting holes 154 to receive a mounting member to secure the frame to the backplane. Further opening 166 will be aligned with and received embossment 159. Arms 160 also have T-projections 168 at either end which are received within recesses 170 on the connector housing 118. The T-projections serve to align and secure the connector housing between the underframe and the overframe. When the assembly is completely assembled, as shown in FIG. 9, the embossments 159 are received through openings 166 and the connector housing 118 is secured between the underframe 120 and the overframe 122. The whole assembly can then be mounted to the backplane using the mounting holes and the solder tails can then be soldered to connection pads along the surface of the backplane.

When fully assembled the backplane connector is aligned such that the openings 124 will be able to receive the contact projections 88 along the assembly 10. The resilient arms on both the ground contacts 92 and the signal contacts 90 will be received along either side of the contact projections 88 such that electrical connection is made between the signal contacts and the ground contacts on the edge connector to the signal and ground contacts on the backplane connector.

The electrical connector of the present invention is constructed to have differential pair construction. This means that two signal contacts are associated with an independent ground contact, the ground contact surrounding the signal contacts to provide electrical isolation from adjacent pairs of signal contacts. The differential pair construction allows the contacts to be mounted much more closely together so that solder tails are all aligned with each other. A further advantage of the present invention is that the use of the flexible film provides a controlled impedance connection between the daughter card and the edge connector. The connection is impedance controlled thereby allowing the transmission of high speed signals (>500 MHz).

The connector of the present invention and many of its attended advantages will be understood from the foregoing description. It is apparent that various changes may be made in the form, construction, an arrangement of parts thereof without departing from the spirit or scope of the invention, or sacrificing all of its material advantages.

What is claimed is:

1. An electrical connector assembly for connecting a daughter card to a mother board, comprising:

a first housing having contacts mounted therein, the contacts being electrically connected to the daughter card;

a second housing being mounted along the edge of the daughter card, the second housing having a mating face and a connecting face, the second housing having contacts mounted therein, the contacts of the second housing being electrically connected to the contacts in the first housing, the mating face having a plurality of contact protrusions forming a field, the contact protrusions having only one contact disposed along one side and only two contacts disposed along another side to form a differential pair.

2. The electrical connector of claim 1, wherein the first housing has both signal and ground contacts, the second housing has both signal and ground contacts, the contact protrusion having a ground contact disposed along the one side and two signal contacts disposed along the other side.

3. The electrical connector of claim 1, wherein a controlled impedance flex film connects the contacts in the first housing to the contacts in the second housing.

4. The electrical connector of claim 1, wherein a frame secures the first housing and the second housing to each other and to the daughter board.

5. The electrical connector of claim 1, wherein the first housing has a cavity for receiving the contacts therein, the contacts have solder tails for electrically connecting with the daughter card and connecting sections for connecting with flex film, a slot extends along the first housing to receive the flex film therein.

6. The electrical connector of claim 5, wherein the second housing has openings for receiving the contacts therein, the contacts having resilient fingers for connecting with the flex film and flat contact surfaces received along the contact protrusions, a slot extending along the openings for receiving the flex film therein.

7. An electrical connector assembly, comprising:

a daughter card having a first housing mounted thereon, the first housings having contacts therein which are electrically connected to the daughter card, the daughter card having a second housing mounted along an edge of the daughter card, the second housing having contacts therein which are electrically connected to the contacts in the first housing, the second housing having a mating face with a plurality of contact protrusions therealong, the contact protrusions having only one contact disposed along one side of the contact protrusion and only two contacts disposed along another side of the contact protrusion forming a differential pair.

8. The electrical connector of claim 7, wherein the first housing has both signal and ground contacts, the second housing has both signal and ground contacts, the contact protrusion having a ground contact disposed along the one side and two signal contacts disposed along the other side.

9. The electrical connector of claim 7, wherein a controlled impedance flex film connects the contacts in the first housing to the contacts in the second housing.

10. The electrical connector of claim 7, wherein a frame secures the first housing and the second housing to each other and to the daughter board.

11. The electrical connector of claim 7, wherein the first housing has a cavity for receiving the contacts therein, the contacts have solder tails for electrically connecting with the daughter card and connecting sections for connecting with flex film, a slot extends along the first housing to receive the flex film therein.

12. The electrical connector of claim 11, wherein the second housing has openings for receiving the contacts therein, the contacts having resilient fingers for connecting with the flex film and flat contact surfaces received along the contact protrusions, a slot extending along the openings for receiving the flex film therein.

13. An electrical connector assembly for connecting a daughter card to a mother board, comprising:

a first housing having contacts mounted therein, the contacts being electrically connected to the daughter card;

a second housing being mounted along the edge of the daughter card, the second housing having a mating face and a connecting face, the second housing having contacts mounted therein, the mating face having a plurality of contact protrusions forming a field, the contact protrusions having only one contact disposed along one side and only two contacts disposed along another side to form a differential pair, the contacts of the second housing being electrically connected to the contacts of the first housing by a flex film.

14. The electrical connector of claim 13, wherein the first housing has both signal and ground contacts, the second housing has both signal and ground contacts, the contact protrusion having a ground contact disposed along the one side and two signal contacts disposed along the other side.

15. The electrical connector of claim 13, wherein the flex film is a controlled impedance flex film.

16. The electrical connector of claim 13, wherein a frame secures the first housing and the second housing to each other and to the daughter board.

17. The electrical connector of claim 13, wherein the first housing has a cavity for receiving the contacts therein, the contacts have solder tails for electrically connecting with the daughter card and connecting sections for connecting with the flex film, a slot extends along the first housing to receive the flex film therein.

18. The electrical connector of claim 17, wherein the second housing has openings for receiving the contacts therein, the contacts having resilient fingers for connecting with the flex film and flat contact surfaces received along the contact protrusions, a slot extending along the openings for receiving the flex film therein.

19. An electrical connector assembly for connecting a daughter card to a mother board, comprising:

a first housing having contacts mounted therein, the contacts being electrically connected to the daughter card and having a connection section;

a second housing being mounted along the edge of the daughter card, the second housing having a mating face and a connecting face, the second housing having contacts mounted therein, the contacts of the second housing being electrically connected to the contacts in the first housing, the mating face having a plurality of contact protrusions forming a field, the contact protrusions having only one contact disposed along one side and only two contacts disposed along another side to form a differential pair;

a third housing being mounted on the mother board, the third housing having contacts therein which are electrically connected to the mother board, the third housing having a plurality of openings to receive the contact protrusions, the openings having one contact disposed along one side and two contacts disposed along the other side to be connected with the contacts on the contact protrusion.

20. The electrical connector of claim 19, wherein the first housing has both signal and ground contacts, the second housing has both signal and ground contacts, the contact protrusion having a ground contact disposed along the one side and two signal contacts disposed along the other side.

21. The electrical connector of claim 19, wherein a controlled impedance flex film connects the contacts in the first housing to the contacts in the second housing.

22. The electrical connector of claim 19, wherein a frame secures the first housing and the second housing to each other and to the daughter board.

23. The electrical connector of claim 19, wherein the first housing has a cavity for receiving the contacts therein, the contacts have solder tails for electrically connecting with the daughter card and connecting sections for connecting with flex film, a slot extends along the first housing to receive the flex film therein.

24. The electrical connector of claim 23, wherein the second housing has openings for receiving the contacts therein, the contacts having resilient fingers for connecting with the flex film and flat contact surfaces received along the contact protrusions, a slot extending along the openings for receiving the flex film therein.

25. The electrical connector of claim 19, wherein the contact protrusions form two parallel rows, the contact protrusions having facing contact surfaces and opposite contact surfaces, ground contacts being disposed along the facing contact surfaces and signal contacts being disposed along the opposite surfaces.

26. The electrical connector of claim 25, wherein the openings within the third housing are disposed in two rows and have ground contacts disposed along inner side walls of the openings and signal contacts are disposed along outer side walls of the openings such that the ground contacts separate pairs of the signal contacts from each other.

27. The electrical connector of claim 26, wherein the signal and ground contacts within the third housing have solder tails for surface mounting to the mother board, the solder tails for both the signal and the ground contacts disposed within openings in one of the two rows are aligned together, the solder tails for the signal and the ground contacts disposed in the openings in the other of the two rows are aligned together.

28. A backplane connector assembly for connecting a daughter card to a backplane, comprising:

a first housing having contacts mounted therein, the contacts being electrically connected to the daughter card and having a connection section;

a second housing being mounted along the edge of the daughter card, the second housing having a mating face and a connecting face, the second housing having contacts mounted therein, the mating face having a plurality of contact protrusions forming a field, the contact protrusions having only one contact disposed along one side and only two contacts disposed along another side to form a differential pair, the contacts of the second housing being electrically connected to the contacts of the first housing by a flex film;

a third housing being mounted on the backplane, the third housing having contacts therein which are electrically connected to the backplane, the third housing having a plurality of openings to receive the contact protrusions, the openings having one contact disposed along one side and two contacts disposed along the other side to be connected with the contacts on the contact protrusion.

* * * * *